US009777500B1

(12) United States Patent
Reisdorff

(10) Patent No.: US 9,777,500 B1
(45) Date of Patent: Oct. 3, 2017

(54) POLE REINFORCEMENT

(71) Applicant: Laminated Wood Systems, Inc., Seward, NE (US)

(72) Inventor: Robert Anthony Reisdorff, Seward, NE (US)

(73) Assignee: Laminated Wood Systems, Inc., Seward, NE (US)

( * ) Notice: Subject to any disclaimer, the term of this patent is extended or adjusted under 35 U.S.C. 154(b) by 0 days.

(21) Appl. No.: 15/192,422

(22) Filed: Jun. 24, 2016

(51) Int. Cl.
*E04H 12/22* (2006.01)
*E04C 3/30* (2006.01)

(52) U.S. Cl.
CPC ..... *E04H 12/2292* (2013.01); *E04C 3/30* (2013.01); *E04H 12/2215* (2013.01); *Y10T 403/50* (2015.01); *Y10T 403/66* (2015.01)

(58) Field of Classification Search
CPC ..... E04H 12/2292; E04H 12/2215; E04G 23/0218; E04C 3/30; Y10T 103/66; Y10T 403/50; Y10T 403/66
USPC .... 52/153, 154, 170, 295, 514, 835, 741.14; 403/DIG. 15
See application file for complete search history.

(56) References Cited

U.S. PATENT DOCUMENTS 731,752 A * 6/1903 Caldwell et al. ... E04H 12/2292 52/295
867,406 A * 10/1907 Pates ..... B60M 5/00 238/14.4
1,018,624 A 2/1912 Kolossvary et al.
1,275,021 A 8/1918 Hardman
1,329,026 A * 1/1920 Snyder ..... E04H 12/22 52/170
1,561,193 A * 11/1925 Spring ..... E04H 12/2292 52/170
1,584,405 A * 5/1926 Spring ..... E04H 12/2292 52/170

(Continued)

FOREIGN PATENT DOCUMENTS

AU 2119295 10/1996
CA 2062874 9/1993

(Continued)

OTHER PUBLICATIONS

McFarland Cascade, Laminated Poles, 2010, entire document, McFarland Cascade, Tacoma Washington, USA.

(Continued)

*Primary Examiner* — Adriana Figueroa
*Assistant Examiner* — Jessie T Fonseca
(74) *Attorney, Agent, or Firm* — Reising Ethington P.C.

(57) ABSTRACT

A utility pole is reinforced by assembling and installing a reinforcement channel assembly comprising a lower reinforcement channel driven into the ground alongside the pole, an inner splice plate supported on and against an inner surface of the lower reinforcement channel, an upper reinforcement channel supported on and against an outer surface of the inner splice plate, and an outer splice plate supported on and against respective outer surfaces of upper and lower portions of the upper and lower reinforcement channels. An outer splice plate is secured to the inner splice plate, sandwiching between them the respective upper and lower portions of the lower and upper reinforcement channels, and the upper reinforcement channel is secured to the pole.

15 Claims, 6 Drawing Sheets

(56) References Cited

U.S. PATENT DOCUMENTS

RE16,494 E * 12/1926 Malone ..... E04H 12/2292 52/154
1,672,789 A * 6/1928 Spring ..... E04H 12/2292 52/170
1,679,747 A * 8/1928 Spring ..... E04H 12/2292 52/170
1,712,364 A * 5/1929 Spring ..... E04H 12/2292 52/170
1,726,371 A * 8/1929 Spring ..... E04H 12/2292 52/170
1,731,645 A * 10/1929 Williams ..... E04H 12/2276 52/155
1,755,461 A * 4/1930 Spring ..... E04H 12/2292 52/170
1,811,899 A 6/1931 Spring
1,817,342 A * 8/1931 Beecher ..... E04H 12/2292 52/170
1,896,964 A * 2/1933 Lind ..... B60M 5/00 238/14.3
2,090,972 A * 8/1937 Allen ..... E04H 12/2292 52/170
2,327,681 A * 8/1943 Vanderveer ..... E04H 12/04 52/835
2,893,778 A 7/1959 Eckstein
2,897,553 A 8/1959 Gorrow
3,309,824 A * 3/1967 Barrett ..... E04G 23/0218 24/20 W
3,344,990 A * 10/1967 Bingmann ..... E01B 11/54 174/138 D
3,390,951 A 7/1968 Finger et al.
3,558,049 A 1/1971 Pennino
3,690,715 A 9/1972 Vanlingen et al.
3,738,072 A * 6/1973 Adrian ..... E04H 12/2292 52/170
4,071,637 A 1/1978 Dittrich et al.
4,523,417 A * 6/1985 Beastall ..... E04B 1/92 52/273
4,618,288 A 10/1986 Daigle
4,621,950 A 11/1986 Kinnan
4,645,228 A * 2/1987 Bertonneau ..... A63C 5/02 280/603
4,697,396 A * 10/1987 Knight ..... E04H 12/2292 52/170
4,697,649 A 10/1987 Kinnan
4,756,130 A * 7/1988 Burtelson ..... E04H 12/2292 52/170
4,892,601 A 1/1990 Norwood
4,921,555 A 5/1990 Skiff
4,987,718 A * 1/1991 Knight ..... E04H 12/2292 52/170
5,043,033 A 8/1991 Fyfe
5,345,732 A * 9/1994 Knight ..... E04H 12/2292 52/153
5,371,986 A * 12/1994 Guditis ..... E04H 12/2292 52/170
5,815,994 A * 10/1998 Knight ..... E04H 12/2292 52/153
6,079,165 A * 6/2000 Bingel, III ..... E04H 12/2292 52/170
6,561,736 B1 * 5/2003 Doleshal ..... E02D 37/00 405/211
7,415,808 B2 * 8/2008 Bingel, III ..... E04C 3/30 52/170
7,562,864 B2 * 7/2009 Robbins, III ..... A01K 3/00 256/52
7,815,157 B2 10/2010 Knight et al.
8,122,652 B2 * 2/2012 Knight ..... E04H 12/2292 52/170
8,984,834 B1 * 3/2015 Butler ..... H02G 7/05 248/218.4
2012/0131864 A1 * 5/2012 Blaylock ..... E04H 12/2292 52/170
2015/0075101 A1 * 3/2015 Semaan ..... C01B 6/24 52/514

FOREIGN PATENT DOCUMENTS

FR 690361 6/1930
WO 9628612 9/1996

OTHER PUBLICATIONS

Lowes Top Choice 1X4X8 Pressure Treated Lumber, Feb. 20, 2013, entire document, LF, LLC. Mooresville, NC, USA.
International Search Report for International Patent Application No. PCT/US95/03149, dated May 30, 1995.
Pile Buck—Timber Pile Points, 2009, 2nd page, ZEB Graphics, New Orleans, LA, USA.

* cited by examiner

POLE REINFORCEMENT

CROSS-REFERENCES TO RELATED APPLICATIONS

Not Applicable

STATEMENT REGARDING FEDERALLY SPONSORED RESEARCH OR DEVELOPMENT

Not Applicable

BACKGROUND

Field

This application relates generally to utility pole reinforcement and, more specifically an assembly and method for assembling and installing spliced-together pole reinforcement channel sections.

Description of Related Art Including Information Disclosed Under 37 CFR 1.97 and 1.98

It is known to reinforce utility poles by driving one or more metal channel sections into the ground alongside them and then securing the channel sections to the pole. Such reinforcement is accomplished by driving a single channel section into the ground along one side of a pole and securing it to the pole, or by driving channel sections into the ground on two sides of a pole and then securing them to the pole.

SUMMARY

A pole reinforcement channel assembly is provided comprising an elongate lower reinforcement channel having a generally U-shaped cross-section, an outer wall, and an open inner side defined by two side walls. The assembly also includes an inner splice plate comprising lower, middle, and upper fastener shafts that extend integrally outward from an outer surface of the inner splice plate, the lower reinforcement channel comprising lower and middle holes that receive the lower and middle fastener shafts of the inner splice plate, respectively, when the inner splice plate is in an installed position against an inner surface of the outer wall of the lower reinforcement channel. The assembly further includes an upper reinforcement channel having a generally U-shaped cross-section, an outer wall, an open inner side defined by two side walls, a hole that receives the upper fastener shaft of the inner splice plate when the upper reinforcement channel is in an installed position against an outer surface of the inner splice plate. The assembly also includes an outer splice plate comprising holes that receive the middle and upper fastener shafts of the inner splice plate when the outer splice plate is in an installed position sandwiching respective upper and lower portions of the lower and upper reinforcement channels against the inner splice plate, the lower fastener shaft of the inner splice plate and the lower hole of the lower reinforcement channel being positioned below the outer splice plate in its installed position.

Also, a method is provided for reinforcing a utility pole by assembling and installing a reinforcement channel assembly. The reinforcement channel is installed and assembled by supporting a lower reinforcement channel alongside the pole, and supporting an inner splice plate on and against an inner surface of the lower reinforcement channel. An upper reinforcement channel is supported on and against an outer surface of the inner splice plate, and an outer splice plate is supported on and against respective outer surfaces of upper and lower portions of the upper and lower reinforcement channels. The outer splice plate is secured to the inner splice plate, sandwiching between them the respective upper and lower portions of the lower and upper reinforcement channels, and securing the upper reinforcement channel to the pole.

DRAWING DESCRIPTIONS

These and other features and advantages will become apparent to those skilled in the art in connection with the following detailed description and drawings of one or more embodiments of the invention, in which.

DETAILED DESCRIPTION

Figure 1:
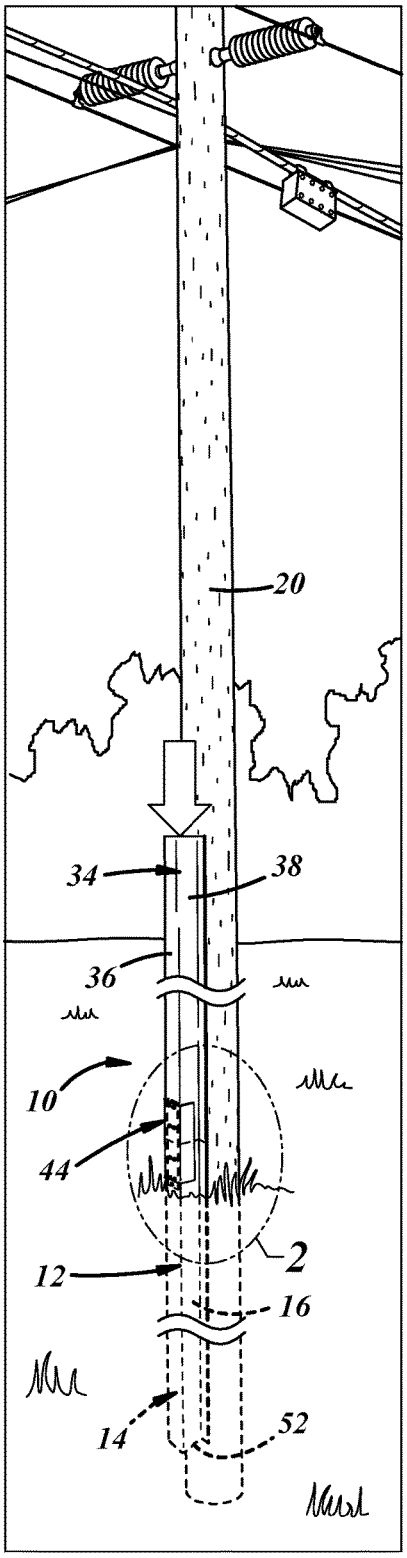
FIG. 1 is a perspective view of a pole reinforcement assembly installed alongside a utility pole.

A first pole reinforcement channel assembly is generally shown at 10 in FIGS. 1-11. The assembly 10 may include an elongate lower reinforcement channel 12 having a generally U-shaped cross-section, an outer wall 14, and an open inner side defined by two side walls 16, 18. The lower reinforcement channel 12 may be configured to be driven into the ground alongside a pole 20 as shown in FIGS. 1-3 and 5. As is also shown in FIGS. 1-3 and 10, the pole 20 alongside which the lower reinforcement channel 12 may be driven into the ground may have a lower end buried in the ground, and preferably with the lower reinforcement channel 12 in a generally parallel orientation relative to and contacting the pole 20. The pole 20 may comprise wood, concrete, and/or any other suitable material.

Figure 5:
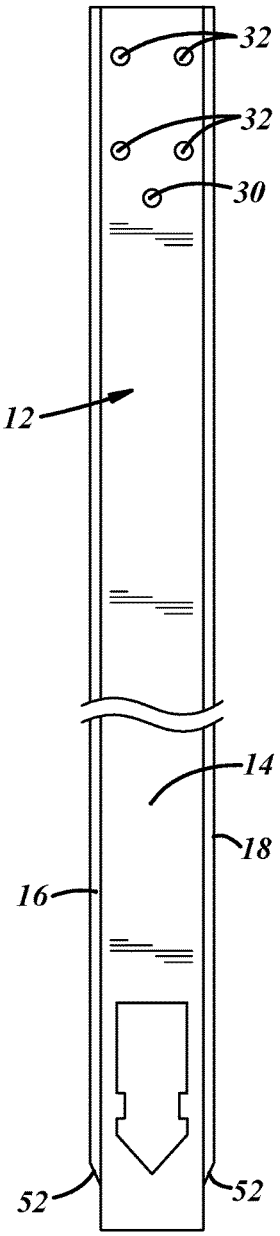
FIG. 5 is a front view of a lower reinforcement channel of either of the pole reinforcement assemblies of FIGS. 3 and 4.
Figure 8:
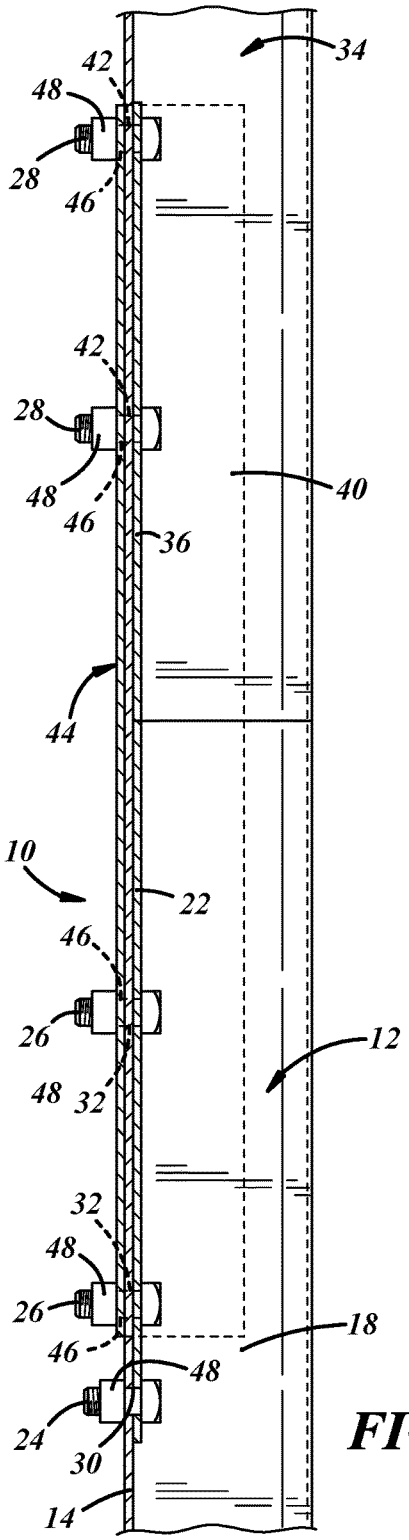
FIG. 8 is a cross-sectional side view of the pole reinforcement assembly section of FIG. 7 taken along line 8 of FIG. 7.
Figure 9:
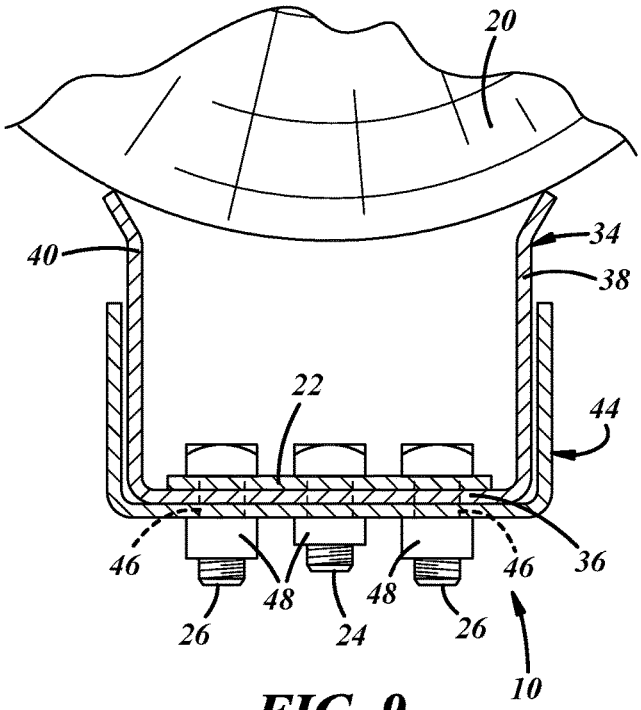
FIG. 9 is a cross-sectional top view of the pole reinforcement assembly section of FIG. 7 taken along line 9 of FIG. 7.

As best shown in FIGS. 2, 8, 9 and 11, the assembly 10 may also include an inner splice plate 22 supportable on the lower reinforcement channel 12 and carrying one lower fastener shaft 24, four middle fastener shafts 26, and four upper fastener shafts 28 that extend integrally outward from and generally normal to an outer surface of the inner splice plate 22. A lower portion of the inner splice plate 22 may be insertable between the lower reinforcement channel 12 and the pole 20 as best shown in FIG. 9, and, as best shown in FIG. 5, the lower reinforcement channel 12 may include a lower hole 30 and four middle holes 32. The lower and middle holes 30, 32 receive the lower and middle fastener shafts 24, 26 of the inner splice plate 22, respectively, when the inner splice plate 22 is in an installed position against an inner surface of the outer wall 14 of the lower reinforcement channel 12 as best shown in FIGS. 8 and 9. In other words, the lower and middle fastener shafts 24, 26 may be insertable through corresponding lower and middle holes 30, 32 formed in an upper end of the lower reinforcement channel 12.

As shown in FIGS. 1-4 and 7-10 the assembly 10 may also include an upper reinforcement channel 34 having a generally U-shaped cross-section, an outer wall 36, an open inner side defined by two side walls 38, 40, and holes 42 that receive the upper fastener shafts 28 of the inner splice plate 22 when the upper reinforcement channel 34 is in an installed position against an outer surface of the inner splice plate 22. In its installed position, and as is best shown in FIGS. 2 and 7-9, the upper reinforcement channel 34 may be disposed on the lower reinforcement channel 12 with a lower end of the upper reinforcement channel 34 abutting the upper end of the lower reinforcement channel 12, the upper end of the inner splice plate 22 extending upward between the upper reinforcement channel 34 and the pole 20, and with the upper fastener shafts 28 extending through the corresponding fastener holes 42 formed in the upper reinforcement channel 34.

As shown in FIGS. 1-3 and 7-10, the assembly 10 may also include an outer splice plate 44 comprising holes 46 that receive the middle and upper fastener shafts 26, 28 of the inner splice plate 22 when the outer splice plate 44 is in an installed position sandwiching respective upper and lower portions of the lower and upper reinforcement channels 34, 12 against the inner splice plate 22. The lower fastener shaft 24 of the inner splice plate 22 and the lower hole 30 of the lower reinforcement channel 12 may be positioned below the outer splice plate 44 in its installed position to allow the inner splice plate 22 to be secured to the lower reinforcement channel 12 and held in place for subsequent installation of the upper reinforcement channel 34 and the outer splice plate 44. In other words, the outer splice plate 44 is installable over the respective upper and lower portions of the upper and lower reinforcement channels 34, 12 with the middle and upper fastener shafts 26, 28 extending through the respective holes formed in the outer splice plate 44. The outer splice plate 44 is fastenable to the inner splice plate 22 in a position sandwiching between them the upper and lower portions of the upper and lower reinforcement channels 34, 12. The outer splice plate 44 does not include a hole positioned to receive the lower fastener shaft 24. This is so that a retainer, which may be in the form of a nut and lock washer, can be installed on the lower fastener shaft 24 following installation of the inner splice plate 22 on the lower reinforcement channel 12 and before installation of the upper reinforcement channel 34.

Figure 10:
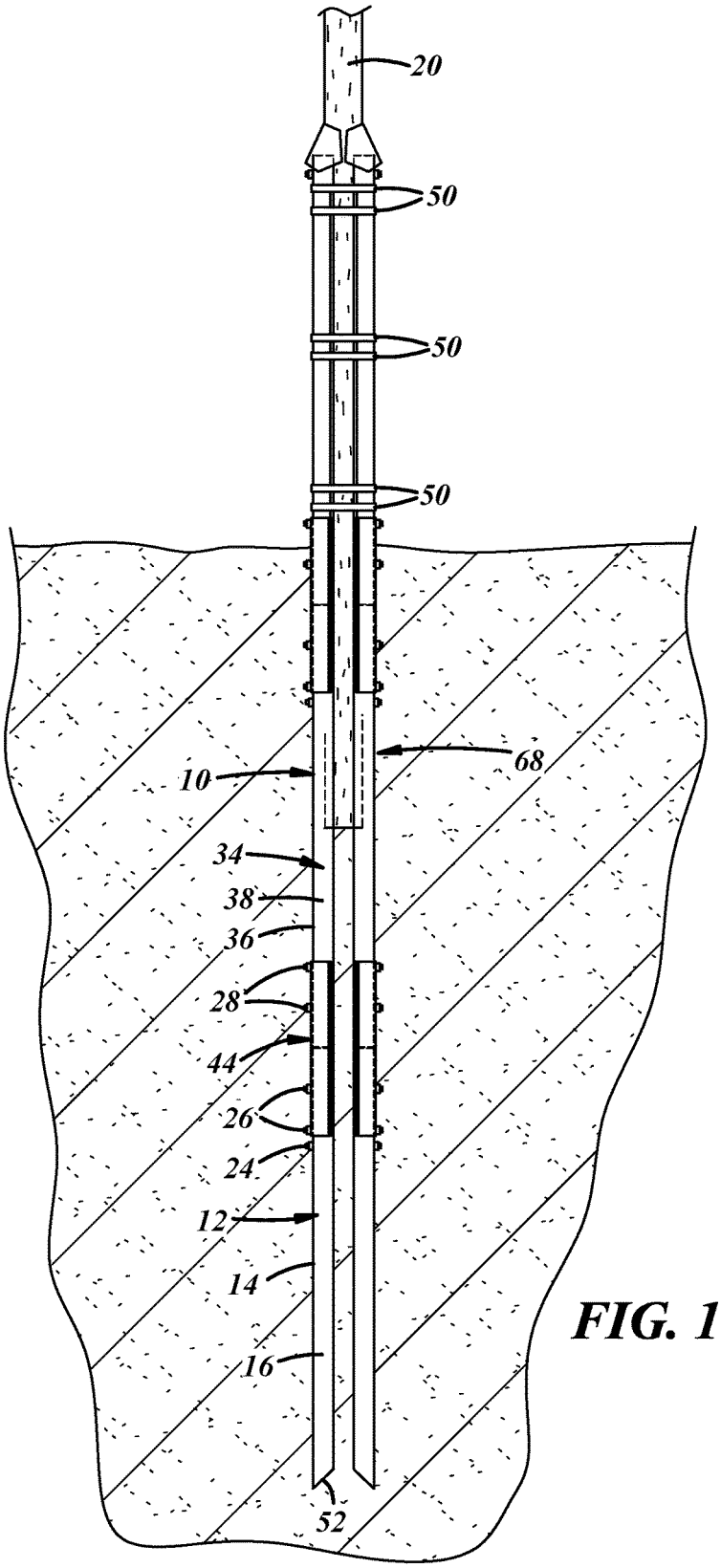
FIG. 10 is a perspective view of the utility pole and pole reinforcement assemblies of FIG. 3 with the assemblies having been driven further into the ground and additional channel sections spliced to upper channel sections of the two assemblies.

As best shown in FIGS. 2 and 7-9, the assembly 10 may include further retainers 48, which may also be in the form of nuts and lock washers, for installation on the middle and upper fastener shafts 26, 28 to secure the outer splice plate 44 to the inner splice plate 22, sandwiching the lower end of the upper reinforcement channel 34 and the upper end of the lower reinforcement channel 12. As shown in FIG. 10 the assembly 10 may also include banding 50 such as, for example, one or more 2" 110,000 psi bands, which may be used to secure the upper reinforcement channel 34 to the pole 20 by wrapping and tightening the band or bands 50 around the first upper reinforcement channel 34 and the pole 20.

Figure 6:
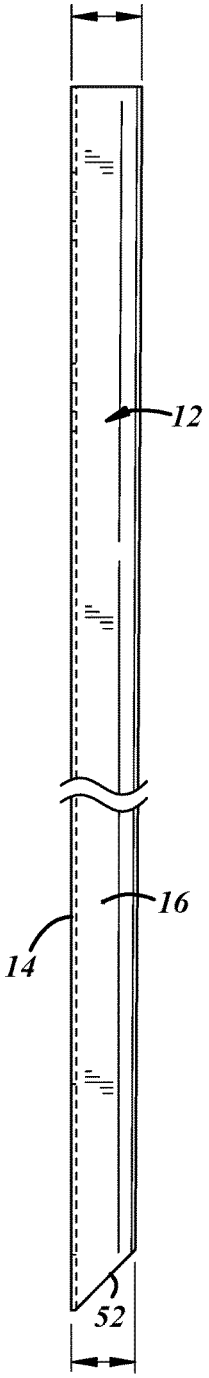
FIG. 6 is a side view of the lower reinforcement channel of FIG. 5.

As best shown in FIG. 6, the lower reinforcement channel 12 may be tapered along its length as defined by side wall width that decreases from an upper to a lower end of the lower reinforcement channel 12. Its tapered shape urges the lower reinforcement channel 12 into contact with the pole 20 as the lower reinforcement channel 12 is driven into the ground alongside the pole 20. To assist in driving the lower reinforcement channel 12 into the ground, and as shown in FIGS. 1, 3, 6, and 10, the lower reinforcement channel 12 may have a beveled lower end that may be defined by diagonal edges 52 at lower ends of the side walls 16, 18.

Figure 2:
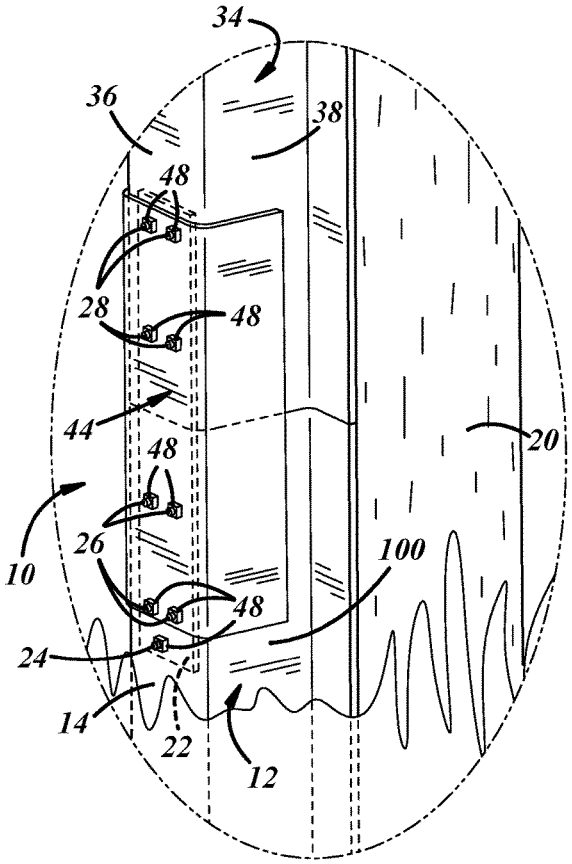
FIG. 2 is a magnified view of a spliced portion of the assembly of FIG. 1, with an inner splice plate of the assembly shown hidden.
Figure 11:
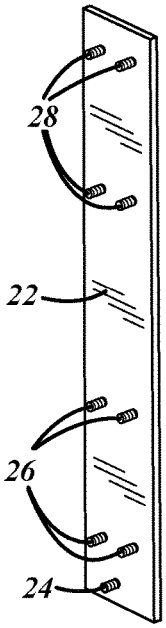
FIG. 11 is a perspective view of the inner splice plate of FIG. 2.
Figure 7:
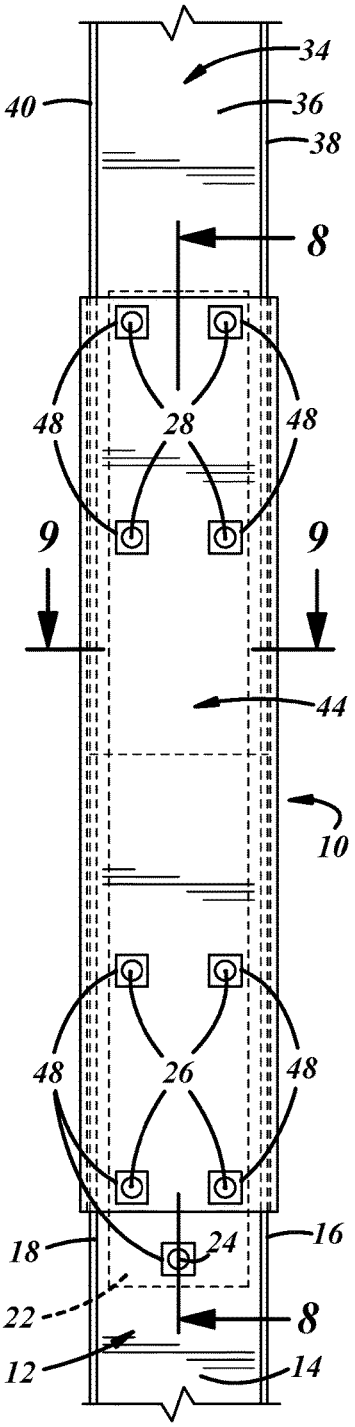
FIG. 7 is a partial front view of either of the pole reinforcement assemblies of FIGS. 3 and 4 showing an outer splice plate supported on fastener shafts extending from an inner splice plate and through the lower reinforcement channel and an upper reinforcement channel.

The outer splice plate 44 may comprise a channel having generally U-shaped cross-section, and may be shaped to fit snugly over the respective lower and upper ends of the upper and lower reinforcement channels 34, 12 as best shown in FIGS. 2, 7, and 10. The upper and lower reinforcement channels 34, 12 and the inner and outer splice plates 22, 44 may all comprise steel.

Figure 12:
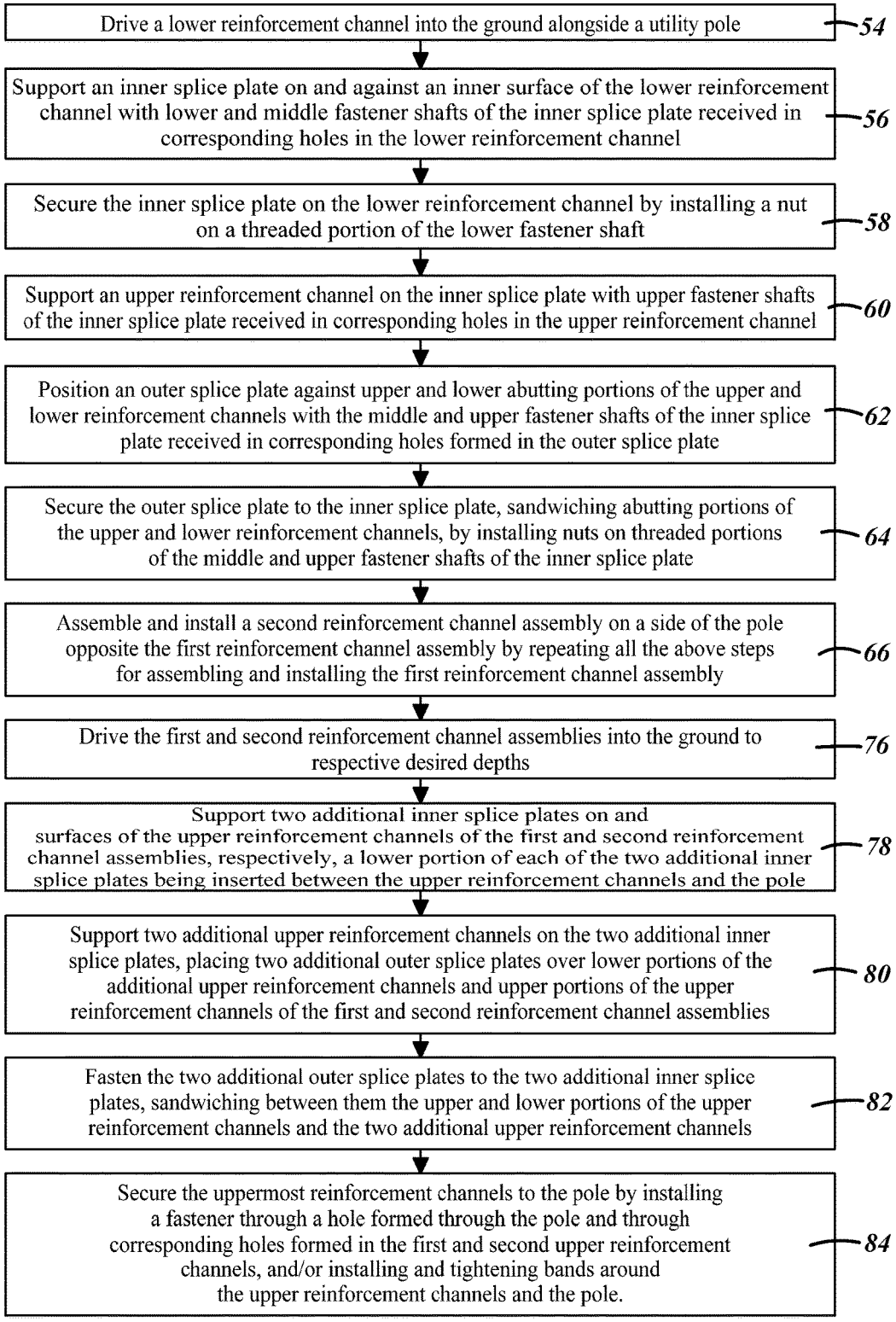
FIG. 12 is a flow chart showing a utility pole reinforcement method.

In practice, and as shown in FIG. 12, a utility pole 20 having one end buried in the ground, may be reinforced by assembling and installing a first reinforcement channel assembly 10. To assemble and install the first reinforcement channel assembly 10 a lower reinforcement channel 12 may be supported alongside an above-ground portion of the pole 20 in a generally parallel orientation relative to and contacting the pole 20. The lower reinforcement channel 12 may then be driven into the ground alongside and in contact with the pole 20, as shown in action step 54, to a depth sufficient to support the pole 20 against breakage at the point along its length where the pole 20 protrudes from the ground, e.g., to a depth of approximately ten feet, leaving approximately 3.5 to 4 feet above ground, and with an open side of the lower reinforcement channel 12 facing the pole 20, the taper in the lower reinforcement channel 12 urging the lower reinforcement channel 12 against the pole 20 as it is driven into the ground.

As shown in action step 56, an inner splice plate 22 may then be supported on and against an inner surface of the lower reinforcement channel 12, which may include inserting a lower portion of the inner splice plate 22 between the lower reinforcement channel 12 and the pole 20, inserting lower and middle fastener shafts 24, 26 of the inner splice plate 22 through corresponding lower and middle fastener holes 30, 32 formed in the lower reinforcement channel 12. As shown in action step 58 the inner splice plate 22 may then be secured on the lower reinforcement channel 12 by installing a retention device on the lower fastener shaft 24, sandwiching the lower reinforcement channel 12 between the retention device and the inner splice plate 22. The retention device may, for example, comprise a nut and a locknut, and installation of the retention device may include placing the locknut on the lower fastener shaft 24 and then screwing the nut onto threads formed on the lower fastener shaft 24.

As shown in action step 60, an upper reinforcement channel 34 may then be supported on and against an outer surface of the inner splice plate 22 in a position on top of the lower reinforcement channel 12, in a generally parallel orientation relative to the pole 20, with open side of the upper reinforcement channel 34 facing the pole 20, a lower end of the upper reinforcement channel 34 abutting the upper end of the lower reinforcement channel 12, and with the upper end of the inner splice plate 22 extending upward between the upper reinforcement channel 34 and the pole 20. At the same time the upper fastener shafts 28 of the inner splice plate 22 may be received in corresponding fastener holes 42 formed in the upper reinforcement channel 34.

At this or any other suitable point during assembly and installation the upper reinforcement channel 34 may be temporarily secured in place by, for example, wrapping and tightening a ratchet strap around both the upper reinforcement channel 34 and the pole 20. As indicated in action step 62, an outer splice plate 44 may be supported on and against outer surfaces of respective upper and lower portions of the upper and lower reinforcement channels 34, 12, which may include receiving the middle and upper fastener shafts 26, 28 of the inner splice plate 22 in corresponding holes formed in the outer splice plate 44.

As indicated in action step 64, the outer splice plate 44 may then be secured to the inner splice plate 22, sandwiching between them the respective upper and lower portions of the lower and upper reinforcement channels 34, 12. The securing may be accomplished by installing retention devices on the middle and upper fastener shafts 26, 28, thus sandwiching the outer splice plate 44 between the retention devices and the upper and lower reinforcement channels 34, 12. Where the retention devices each comprise, for example, a nut and a locknut, installation of the retention devices may include placing the locknuts on the middle and upper fastener shafts 26, 28 and then screwing the nuts onto threads formed on the middle and upper fastener shafts 26, 28. The upper reinforcement channel 34 may then be permanently secured to the pole 20 by, for example, wrapping and tightening a band around the first upper reinforcement channel 34 and the pole 20.

Figure 3:
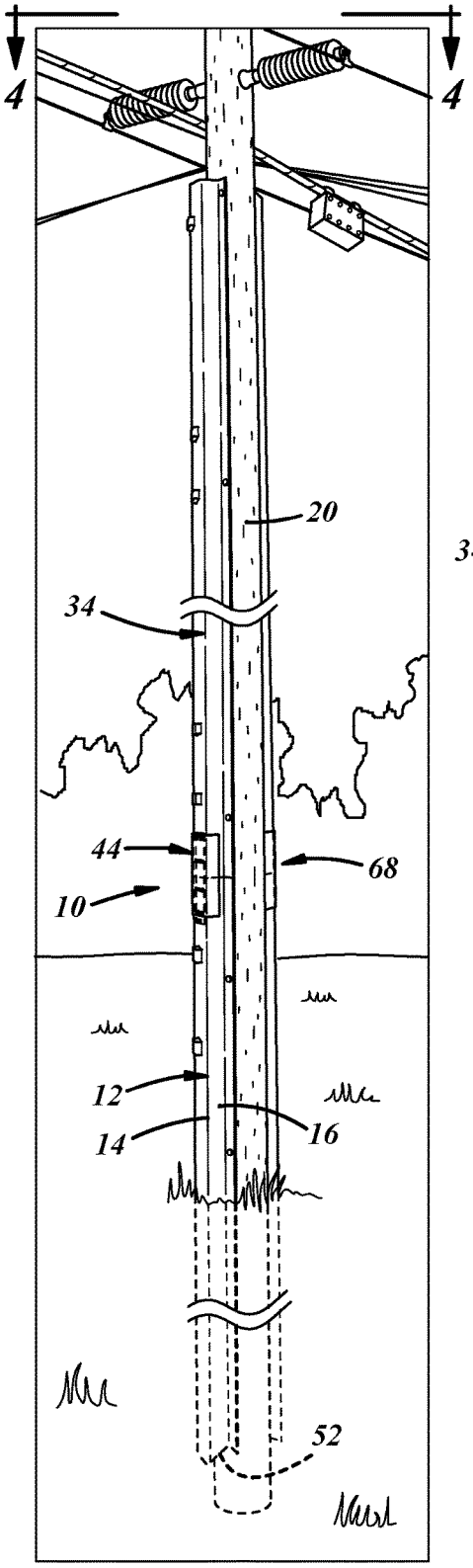
FIG. 3 is a perspective view of two pole reinforcement assemblies installed along opposed sides of a utility pole.
Figure 4:
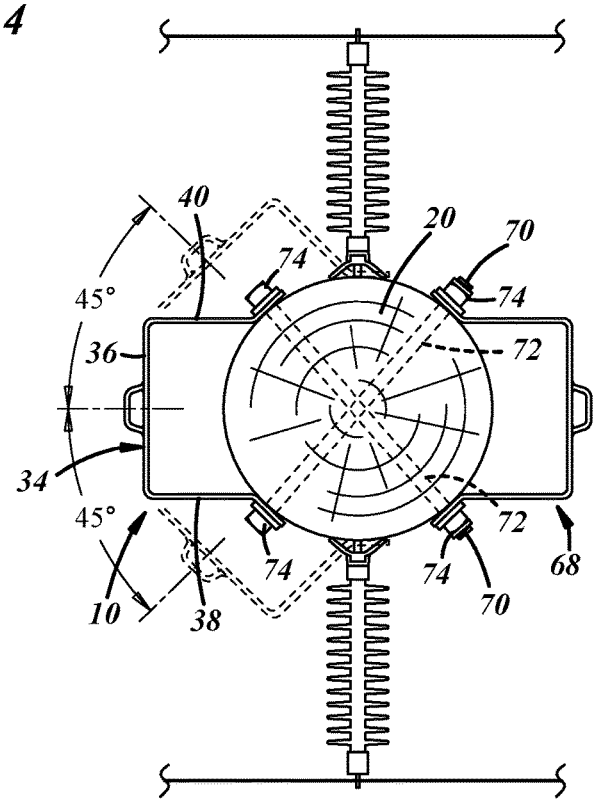
FIG. 4 is a top view of the utility pole and pole reinforcement assemblies of FIG. 3, taken along line 4-4 of FIG. 3.

As indicated in action step 66 and as shown in FIGS. 3, 4, and 10, a second reinforcement channel assembly 68 may be assembled and installed on a side of the pole 20 opposite the first reinforcement channel assembly 10 by repeating the assembly and installation steps set forth above with regard to the first reinforcement channel assembly 10. The upper reinforcement channels of the first and second reinforcement channel assemblies 10, 68 may then be secured to the pole 20 by, for example, wrapping and tightening a band 50 around the pole 20 and the upper reinforcement channels of the first and second reinforcement channel assemblies 10, 68 as shown in FIG. 10. Alternatively, or in addition, the upper reinforcement channels of the first and second reinforcement channel assemblies 10, 68 may be secured to the pole 20 by installing fasteners 70 through holes formed generally horizontally through the pole 20 and through corresponding holes formed in the first and second upper reinforcement channels as shown in FIG. 4. The fasteners 70 may each include a rod 72 threaded at both ends, which may be secured following insertion by threading nuts 74 on both ends.

As shown in FIG. 10, for applications requiring additional support, e.g., for 30 foot and longer installations, the first and second reinforcement channel assemblies 10, 68 may each be driven further into the ground as indicated in action step 76 of FIG. 12. The assemblies 10, 68 may, for example, be driven another 3.5 to 4 feet into the ground, and may then be secured to the pole 20. Additional upper reinforcement channels may be added on top of the first and second reinforcement channel assemblies 10, 68 using further inner and outer splice plates 22, 44 and associated mounting hardware.

More specifically, and as indicated in action step 78 of FIG. 12, before or after driving the first and second reinforcement channel assemblies 10, 68 further into the ground, two additional inner splice plates may be supported on the upper reinforcement channels of the first and second reinforcement channel assemblies 10, 68, respectively, with a lower portion of each of the two additional inner splice plates being inserted between the pole 20 and the upper reinforcement channels of the first and second reinforcement assemblies, and with lower and middle fastener shafts of the additional inner splice plates being received in corresponding holes formed in the upper reinforcement channels of the first and second reinforcement assemblies. As indicated in action step 80, two additional upper reinforcement channels may then be supported on the two additional inner splice plates, with upper fastener shafts of the additional inner splice plates being received in corresponding holes formed in the lower ends of the two additional upper reinforcement channels. Two additional outer splice plates may then be positioned over the lower portions of the additional upper reinforcement channels and upper portions of the upper reinforcement channels of the first and second reinforcement channel assemblies 10, 68, with the middle and upper fastener shafts, extending through corresponding holes formed in the outer splice plates and then, as indicated in action step 82, the two additional outer splice plates may be secured to the two additional inner splice plates, sandwiching between them the upper and lower portions of the upper reinforcement channels and the two additional upper reinforcement channels. The additional upper reinforcement channels may then be secured to the pole 20 as indicated in action step 84.

To secure the upper reinforcement channels of the first and second reinforcement channel assemblies 10, 68 to the pole 20, a plurality of bands 50, e.g., 2" 110,000 psi banding, may be wrapped around the pole 20 and the upper reinforcement channels at vertically-spaced locations. Alternatively, a plurality of fasteners may be installed through respective generally horizontal holes formed through the pole 20 and through corresponding holes formed in the first and second upper reinforcement channels. The fasteners may include rods having threaded opposite ends, which may be secured by threading nuts on either end following insertion.

The openings formed between the pole 20 and the upper ends of the upper reinforcement channels of the first and second reinforcement channel assemblies 10, 68 may be closed by, for example, installing appropriately-shaped steel safety caps over the openings.

This description, rather than describing limitations of an invention, only illustrates embodiments of the invention recited in the claims. The language of this description is therefore exclusively descriptive and is non-limiting.

Obviously, it's possible to modify this invention from what the description teaches. Within the scope of the claims, one may practice the invention other than as described above.

What is claimed is:

1. A pole reinforcement assembly comprising:

an elongate lower reinforcement channel having a generally U-shaped cross-section, an outer wall, and an open inner side defined by two side walls;

an inner splice plate comprising lower, middle, and upper fastener shafts that extend integrally outward from an outer surface of the inner splice plate, the lower reinforcement channel comprising lower and middle holes that receive the lower and middle fastener shafts of the inner splice plate, respectively, when the inner splice plate is in an installed position against an inner surface of the outer wall of the lower reinforcement channel;

an upper reinforcement channel having a generally U-shaped cross-section, an outer wall, an open inner side defined by two side walls, a hole that receives the upper fastener shaft of the inner splice plate when the upper reinforcement channel is in an installed position against an outer surface of the inner splice plate; and an outer splice plate comprising holes that receive the middle and upper fastener shafts of the inner splice plate when the outer splice plate is in an installed position sandwiching respective upper and lower portions of the lower and upper reinforcement channels against the inner splice plate, the lower fastener shaft of the inner splice plate and the lower hole of the lower reinforcement channel being positioned below and outside a perimeter of the outer splice plate in its installed position.

2. A pole reinforcement assembly as defined in claim 1 in which the lower reinforcement channel is tapered along its length.

3. A pole reinforcement assembly as defined in claim 1 in which the outer splice plate comprises a channel having generally U-shaped cross-section and shaped to fit over the upper and lower reinforcement channels.

4. A method for reinforcing a utility pole by assembling and installing a first reinforcement channel assembly by:

supporting a lower reinforcement channel alongside the pole;

supporting an inner splice plate on and against an inner surface of the lower reinforcement channel such that a lower portion of the inner splice plate is inserted between the lower reinforcement channel and the pole and such that lower and middle fastener shafts of the inner splice plate are inserted through corresponding holes formed in the lower reinforcement channel;

supporting an upper reinforcement channel on and against an outer surface of the inner splice plate;

supporting an outer splice plate on and against respective outer surfaces of upper and lower portions of the upper and lower reinforcement channels in an installed position in which the lower fastener shaft of the inner splice plate and the lower hole of the lower reinforcement channel are positioned below and outside a perimeter of the outer splice plate; and securing the outer splice plate to the inner splice plate, sandwiching between them the respective upper and lower portions of the lower and upper reinforcement channels; and securing the upper reinforcement channel to the pole.

5. The method of claim 4 in which the step of supporting a lower reinforcement channel alongside a pole includes driving the lower reinforcement channel into the ground alongside the pole, the pole having a lower end buried in the ground.

6. The method of claim 4 in which the step of supporting an inner splice plate on the lower reinforcement channel includes retaining the inner splice plate on the lower reinforcement channel by installing a retention device on the lower fastener shaft.

7. The method of claim 4 in which the step of supporting an upper reinforcement channel on and against an outer surface of the inner splice plate includes receiving an upper fastener shaft of the inner splice plate in an upper fastener hole formed in the upper reinforcement channel.

8. The method of claim 4 in which the step of supporting an outer splice plate on and against outer surfaces of respective upper and lower portions of the upper and lower reinforcement channels includes receiving the middle and upper fastener shafts of the inner splice plate in corresponding holes formed in the outer splice plate.

9. The method of claim 8 in which the step of securing the outer splice plate to the inner splice plate includes installing retention devices on the middle and upper shafts.

10. The method of claim 4 in which the step of securing the upper reinforcement channel to the pole includes wrapping and tightening a band around the first upper reinforcement channel and the pole.

11. The method of claim 4 in which a second reinforcement channel assembly is assembled and installed on a side of the pole opposite the first reinforcement channel assembly by:

repeating the assembly and installation steps of the first reinforcement channel assembly; and then securing the upper reinforcement channels of the first and second channel assemblies to the pole.

12. The method of claim 11 in which repeating the assembly and installation steps of the first reinforcement channel includes driving the lower reinforcement channels of the first and second reinforcement channel assemblies to respective desired depths.

13. The method of claim 12 including the additional steps of:

driving the first and second reinforcement channel assemblies into the ground;

supporting two additional inner splice plates on and against inner surfaces of the upper reinforcement channels of the first and second reinforcement channel assemblies, respectively, a lower portion of each of the two additional inner splice plates being inserted between the upper reinforcement channels and the pole;

supporting two additional upper reinforcement channels on the two additional inner splice plates, placing two additional outer splice plates over lower portions of the two additional upper reinforcement channels and upper portions of the upper reinforcement channels of the first and second reinforcement channel assemblies;

securing the two additional outer splice plates to the two additional inner splice plates, sandwiching between them the upper and lower portions of the upper reinforcement channels and the two additional upper reinforcement channels; and securing the additional upper reinforcement channels to the pole.

14. The method of claim 4 in which the step of securing the upper reinforcement channels to the pole includes installing a fastener through a hole formed through the pole and through corresponding holes formed in the first and second upper reinforcement channels.

15. The method of claim 4 in which the step of securing the upper reinforcement channels to the pole includes wrapping a band around the upper reinforcement channels and the pole.

* * * * *